US008860256B2

(12) United States Patent
Rosenbauer

(10) Patent No.: US 8,860,256 B2
(45) Date of Patent: Oct. 14, 2014

(54) DOMESTIC APPLIANCE, ESPECIALLY A DISHWASHER OR WASHER

(75) Inventor: Michael Georg Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 565 days.

(21) Appl. No.: 13/003,767

(22) PCT Filed: Jul. 23, 2009

(86) PCT No.: PCT/EP2009/059489

§ 371 (c)(1),
(2), (4) Date: Jan. 12, 2011

(87) PCT Pub. No.: WO2010/010146

PCT Pub. Date: Jan. 28, 2010

(65) Prior Publication Data

US 2011/0115306 A1 May 19, 2011

(30) Foreign Application Priority Data

Jul. 25, 2008 (DE) ..... 10 2008 040 744

(51) Int. Cl.

| | |
|---|---|
| ***H01H 83/00*** | (2006.01) |
| ***D06F 33/02*** | (2006.01) |
| ***A47L 15/00*** | (2006.01) |
| ***A47L 15/46*** | (2006.01) |
| *D06F 58/28* | (2006.01) |

(52) U.S. Cl.

CPC ..... *D06F 33/02* (2013.01); *A47L 2401/20* (2013.01); *A47L 15/0047* (2013.01); *A47L 2501/32* (2013.01); *A47L 15/46* (2013.01); *D06F 2220/00* (2013.01); *D06F 2210/00* (2013.01); *D06F 2058/2896* (2013.01)

USPC ..... 307/116; 307/149; 307/80; 307/110; 307/39; 307/125; 700/282; 700/83; 700/17; 134/18

(58) Field of Classification Search

USPC ..... 307/116.125, 112; 700/83, 14, 18, 19, 700/65; 340/3.32, 3.9; 257/43; 320/107, 320/103

See application file for complete search history.

(56) References Cited

U.S. PATENT DOCUMENTS

| | | | | |
|---|---|---|---|---|
| 4,955,213 | A | 9/1990 | Ohsugi et al. | |
| 5,150,489 | A | 9/1992 | Kaji et al. | |
| 7,110,836 | B2 * | 9/2006 | Sturm et al. | 700/83 |
| 7,388,306 | B2 * | 6/2008 | Peterson | 307/149 |
| 7,884,498 | B2 * | 2/2011 | Ecker et al. | 307/35 |
| 7,960,944 | B2 * | 6/2011 | Hoffman et al. | 320/107 |
| 8,314,516 | B2 * | 11/2012 | Federmann et al. | 307/125 |
| 2007/0017551 | A1 * | 1/2007 | Hartogh | 134/18 |
| 2009/0157231 | A1 * | 6/2009 | Do et al. | 700/297 |

FOREIGN PATENT DOCUMENTS

| | | | |
|---|---|---|---|
| DE | 4343105 | A1 | 6/1995 |
| DE | 10308204 | B3 | 2/2004 |
| DE | 102006029708 | A1 | 2/2007 |
| JP | 60048789 | A | 3/1985 |
| JP | 60119990 | A | 6/1985 |

* cited by examiner

*Primary Examiner* — Jared Fureman
*Assistant Examiner* — Jagdeep Dhillon
(74) *Attorney, Agent, or Firm* — James E. Howard; Andre Pallapies

(57) ABSTRACT

A domestic appliance having a control device to control device components of the domestic appliance during execution of a program, wherein the device components have electrical loads. The domestic appliance also has a switch to at least partly de-energize the control device after the program has finished executing.

10 Claims, 3 Drawing Sheets

DOMESTIC APPLIANCE, ESPECIALLY A DISHWASHER OR WASHER

BACKGROUND OF THE INVENTION

The invention relates to a domestic appliance, in particular a dishwasher or a washing machine.

Domestic appliances, such as dishwashers or washing machines for example, have a controller which controls various device components of the domestic appliance, such as pump motors and/or valves and also display elements for example, during the execution of a program. After the execution of the program the controller and also the display elements are supplied with electrical energy until such time as a person operating the machine switches said elements off by manually actuating a main switch to switch the domestic appliance on and/or off.

BRIEF SUMMARY OF THE INVENTION

The object of the invention is thus to provide a domestic appliance with reduced energy consumption.

The above object is achieved on the basis of a domestic appliance, in particular a dishwasher or washing machine, having at least one control device for controlling device components, comprising electrical loads of the domestic appliance, during the execution of the program.

There is inventive provision for at least one switching means to be provided for powering off the control device after the end of the program execution. This achieves an energy saving in a surprisingly simple manner in that, after the execution of the program, the control device is isolated entirely or just partly from a domestic power supply network by powering it off.

Preferably there is provision for a delay element to be provided for powering off the control device after a predetermined period of time has elapsed. This makes it possible, for a period of 30 minutes for example, for the domestic appliance to signal a program execution to a person operating the appliance by means of acoustic and/or optical signals. After this period has elapsed the household appliance is isolated from the domestic supply network by powering it off. In such cases there can preferably be provision for the predeterminable period of time to be set manually by an operator and/or for the delay element to be able to be deactivated entirely.

In this case there is preferably provision for the control device to have at least a first group of modules for controlling the domestic appliance before the beginning and/or after the ending of a program execution and a second group of modules for controlling the domestic appliance while a program is executing.

The first group of modules can preferably comprise at least one operating and/or display module for controlling operating and/or display elements, while the second group of modules can preferably comprise at least one control module for controlling device components during the execution of a program.

Preferably there is also provision for at least one switching means for powering off the second group of modules to be provided. Thus the second group of modules for controlling device components can be isolated from the domestic supply network after the execution of the program by powering it off, while the first group of modules for controlling operating and/or display elements continues to be provided with electrical energy. This makes it possible for acoustic and/or optical signals to inform an operator about the execution of the program.

For this purpose the at least one switching means is preferably actively connected to the first group of modules so that a switching process of the at least one switching means can be initiated by a control signal of the first group of modules.

There is also preferably provision for a second switching means to be provided for powering off at least the first group of modules. For this purpose the first group of modules is preferably effectively connected to the second switching means, especially to enable it to be powered off after the program has finished executing.

In addition a further delay element is provided for powering off the first group of modules after a period of time has elapsed. Thus the first group of modules can be isolated from the domestic supply network by powering it off after a predetermined period of time has elapsed after program execution.

For this purpose the second switching means is preferably embodied as a main switch with which the domestic appliance can be at least manually switched on.

Finally there is preferably provision for the main switch to isolate the domestic appliance automatically from the electrical supply network after the execution of a program.

BRIEF DESCRIPTION OF THE DRAWINGS

Two exemplary embodiments of the invention are described below with reference to the enclosed figures.

The figures show.

DETAILED DESCRIPTION OF EXEMPLARY EMBODIMENTS OF THE PRESENT INVENTION

Figure 1:
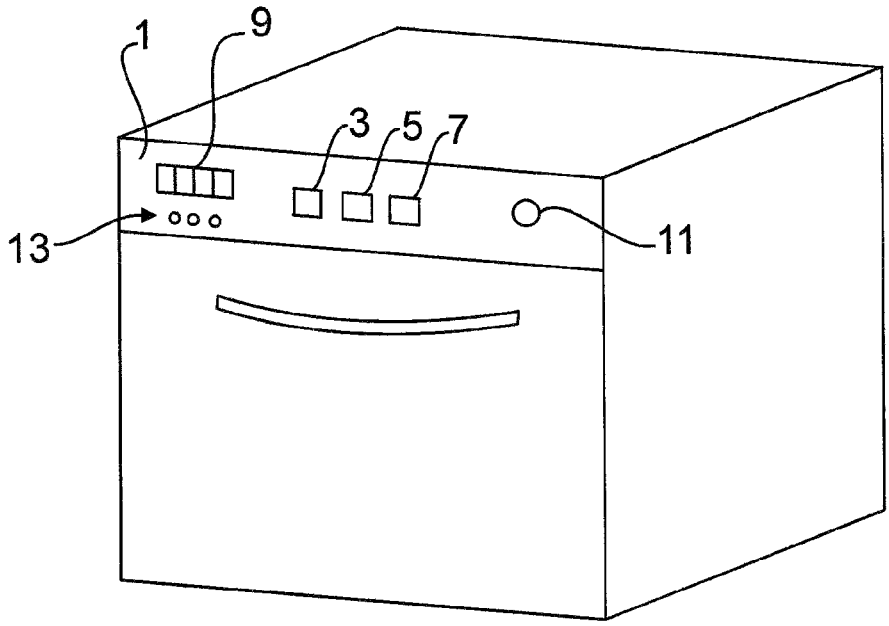
FIG. 1 a perspective view of the dishwasher.

FIG. 1 shows a dishwasher with a front control panel 1 as an exemplary embodiment of a domestic appliance. Three program switches 3, 5, 7 are provided in roughly the center of the control panel 1 for selecting different dishwashing programs. The dishwasher also has a display unit 9 which can typically display a time of day as well as a dishwashing program duration. The display unit 9 can for example have four seven-segment displays able to be controlled by a control device. In the known manner a main switch 11 for switching the device on and off is also provided in the control panel 1 of the dishwasher, which isolates the dishwasher from a mains power supply of the electrical power network or connects it to said network.

The dishwasher shown in FIG. 1 is also equipped with a time pre-selection function, by means of which a period of time $\Delta t_v$ is able to be set by a user. Only after this user-set period $\Delta t_v$ has elapsed does the dishwasher actually start to operate, so that during this period of time $\Delta t_v$ the dishwasher is in standby mode while the main switch 11 is switched on. The period of time $\Delta t_v$ can be set by means of the control elements 13 indicated below the display unit 9 in FIG. 1.

Figure 2:
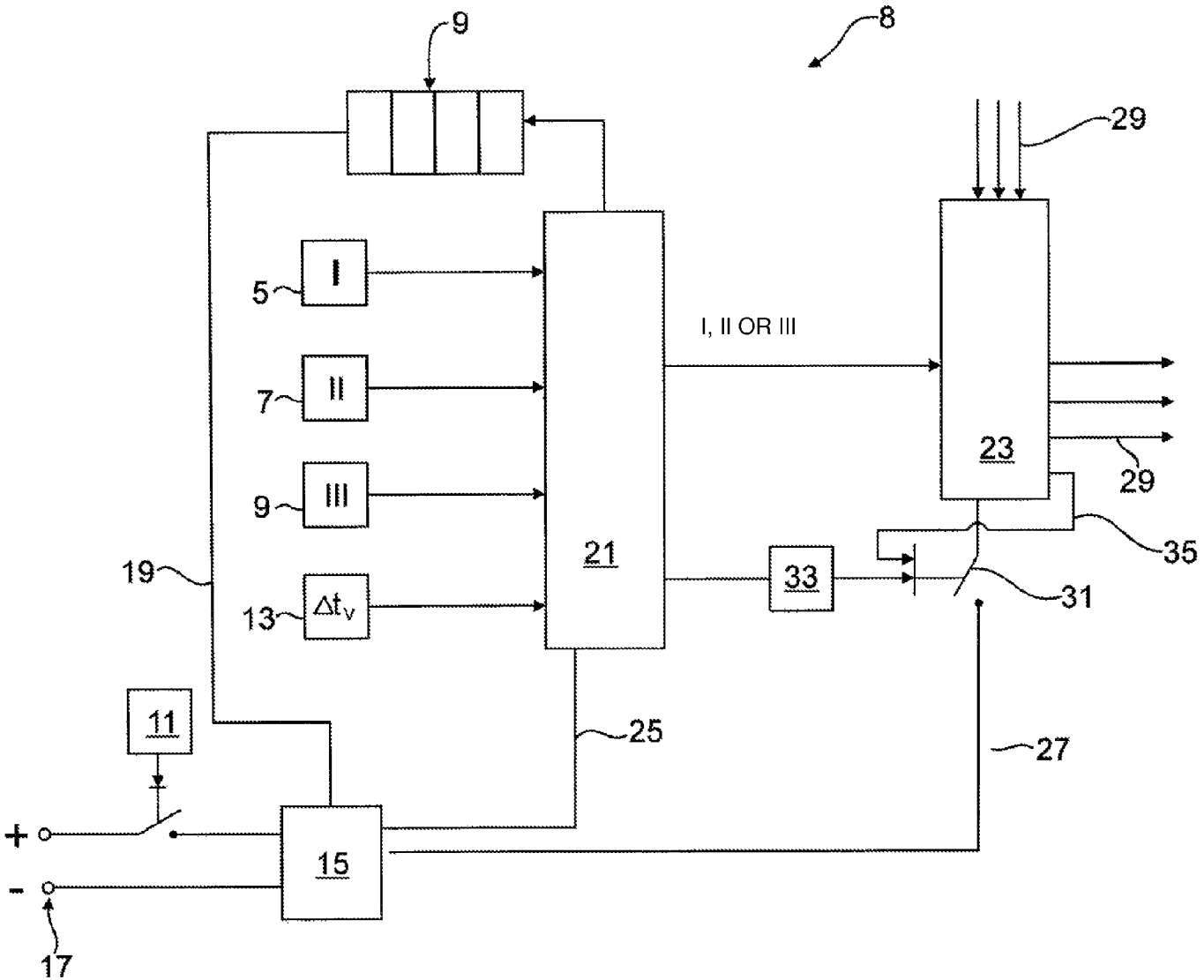
FIG. 2 a basic circuit diagram of a control device of the dishwasher in accordance with the first exemplary embodiment.

FIG. 2 shows a greatly simplified basic circuit diagram of a first exemplary embodiment of the control device 8 of the dishwasher. The control device 8 is connected via a power adapter 15 to the electrical power supply network 17 and the connection passes through the main switch 11 via which the dishwasher is able to be isolated from or connected to the electrical power supply network 17. In a known manner the device components of the dishwasher are supplied with suitable DC or AC voltages via the power adapter 15. For example the display unit 9 is connected to a power supply line 19.

The control device 8 also has a first group of modules 21 comprising at least one operating and/or display electronics component. The control device 8 additionally has a second group of modules 23 which includes a control electronics module. Both module groups 21, 23 are supplied with electrical energy via further supply lines 25, 27 from the power adapter 15. The first module group 21, with the operating and/or display electronics module, is used on the one hand as an input unit for program inputs by means of the program switch 3, 5, 7 and also the actuation elements 13, of which only one actuation element 13 is shown by way of example in FIG. 2, with which the period of time $\Delta t_v$ is able to be set. The first group of modules 21 also directs corresponding control signals to the display unit 9.

The first group of modules 21 is also connected for signal transmission to the second group of modules 23, which during a predetermined operational period controls a rinse cycle of the dishwasher. Accordingly the second group of modules 23 is connected via signal lines 29 to the electrical device components of the dishwasher not shown in the figure.

In the power supply line 27 routed from the power adapter 15 to the control electronics module 23 a switch is provided as a switching means 31 which can isolate the second group of modules 23 from the power adapter 15 or from the electrical power supply network 17 and thus de-energize it or can connect it to said units. The switching means 31 is actuated by means of a delay element 33 which is connected for signaling to the first group of modules 21. In this case the delay element 33 holds the switching means 31 in its open position during the entire preset period of time $\Delta t_v$. This means that during the preset period of time $\Delta t_v$ up to the actual program start of the dishwasher, the power supply to the control electronics module 23 is interrupted. Only at program start will the switching means 31 be closed by means of the delay element 33 and accordingly the second module group 23 activated. In this way, while the preset period of time $\Delta t_v$ is elapsing, the second module group 23, usually operating with increased energy demand in standby mode, is de-energized while only the first module group 21 operating with reduced energy demand is energized.

As can also be seen from FIG. 2, the switching means 31 is connected via a signal line 35 to the second module group 23. After the dishwasher completes its rinse cycle the second group of modules 23 generates a control signal which puts the switching means 31 back into its open position. In this way, the second group of modules 23 is also isolated from the electrical power supply network 17 again after the rinse cycle has finished.

Figure 3:
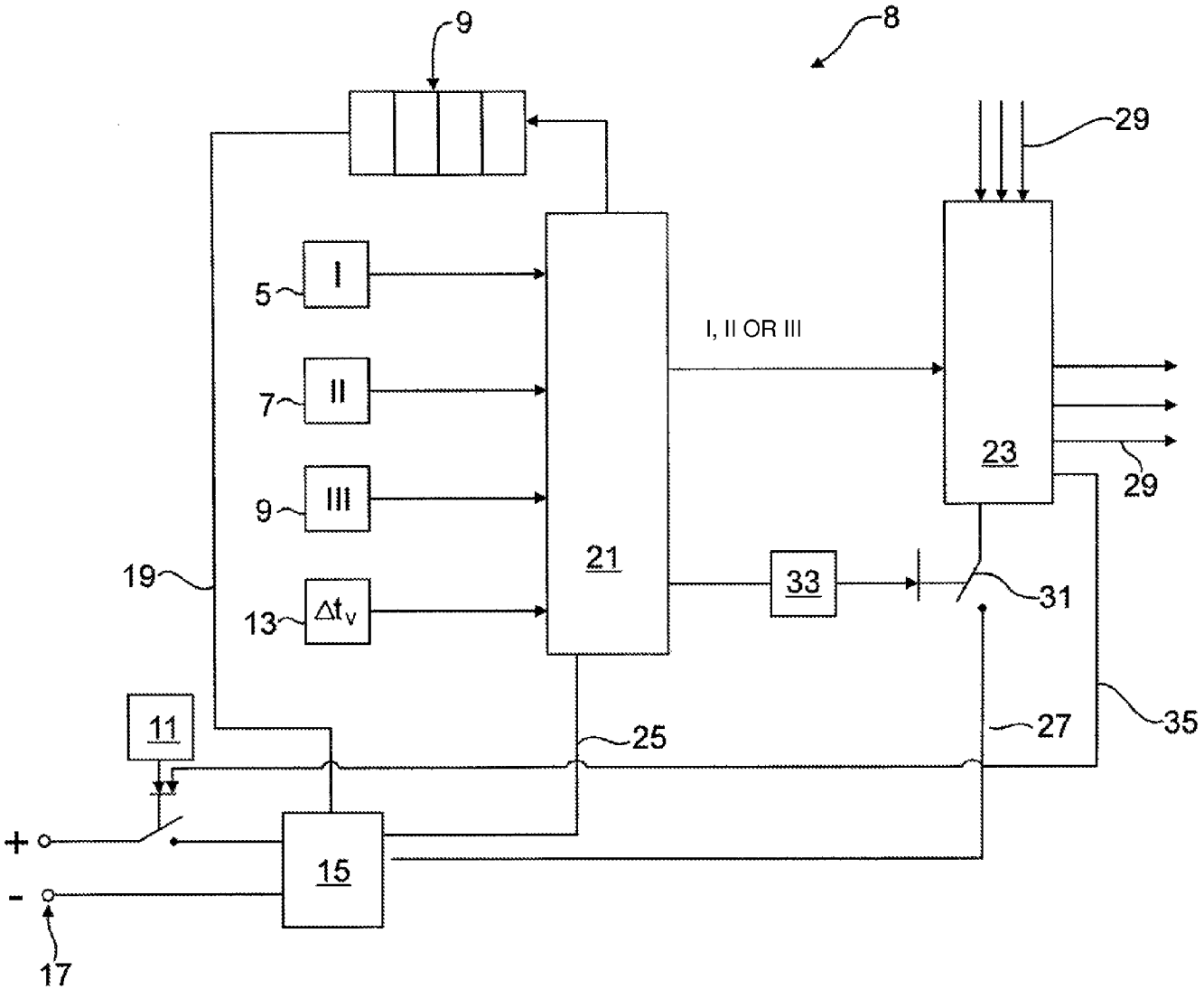
FIG. 3 a corresponding basic circuit diagram of a control device of the dishwasher in accordance with the second exemplary embodiment of the invention.

A further basic circuit diagram of the control device 8 of the dishwasher is shown in accordance with the second exemplary embodiment in FIG. 3. The structure and the functions of the control device 8 shown therein are essentially identical to those in the exemplary embodiment shown in FIG. 2. In this respect reference is made to the description of said figure.

Unlike FIG. 2, the second group of modules 23 has no direct signal connection to the switching means 31. Instead the second group of modules 23 is coupled to a second switching means 11 serving as a main switch. After the rinse cycle is completed the second group of modules 23 can thus likewise generate a corresponding signal and transmit it to the second switching means 11, which isolates the entire dishwasher from the domestic power supply network 17. This enables energy losses after the program has completed its execution to be completely avoided.

LIST OF REFERENCE CHARACTERS

1 Control panel
3 Program switch
5 Program switch
7 Program switch
9 Display unit
11 Second switching means
13 Control elements
15 Power adapter
17 Electrical power supply network
19 Power supply line
21 First group of modules
23 Second group of modules
25 Power supply line
27 Power supply line
29 Signal lines
31 First switching means
33 Delay element
35 Signal line
I Wash program
II Wash program
III Wash program
$\Delta t_v$ Period of time

The invention claimed is:

1. A domestic appliance, comprising:

a control device to control device components of the domestic appliance during execution of a program, the device components having electrical loads, the control device having a first group of a plurality of modules to control the domestic appliance at least one of before the beginning and after the end of the program execution, and a second group of a plurality of modules to control the domestic appliance while the program is executing;

a switch that de-energizes the second group of modules after the program has finished executing, the switch de-energizing the second group of modules in response to a control signal when the program is finished executing; and a delay element that delays the control signal to de-energize the second group of modules for a predetermined period of time after the program has finished executing, wherein the switch is separate from the first group and is separate from the second group.

2. The domestic appliance of claim 1, wherein the domestic appliance is one of a dishwasher and a washing machine.

3. The domestic appliance of claim 1, wherein the first group of modules has at least one of an operating module and a display module to control at least one of operating elements and display elements.

4. The domestic appliance of claim 1, wherein the second group of modules has at least one control module to control the device components while the program is executing.

5. The domestic appliance of claim 1, wherein the switch is actively connected to the first group of modules.

6. The domestic appliance of claim 1, wherein the switch also de-energizes the first group of modules.

7. The domestic appliance of claim 6, wherein the switch is a main switch with which the domestic appliance is manually switched on.

8. The domestic appliance of claim 7, wherein the main switch automatically isolates the domestic appliance from an electrical power supply network after the program has executed.

9. The domestic appliance of claim 1, wherein the predetermined period of time begins after the program finishes executing and ends after the program finishes executing.

10. The domestic appliance of claim 1, wherein the program is a rinse cycle and the switch at least partly de-energizing the control device in response to the rinse cycle completing.

* * * * *